US009734947B2

(12) United States Patent
Nakamura

(10) Patent No.: US 9,734,947 B2
(45) Date of Patent: Aug. 15, 2017

(54) RARE EARTH SINTERED MAGNET AND MAKING METHOD

(71) Applicant: SHIN-ETSU CHEMICAL CO., LTD., Tokyo (JP)

(72) Inventor: Hajime Nakamura, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 371 days.

(21) Appl. No.: 14/055,064

(22) Filed: Oct. 16, 2013

(65) Prior Publication Data

US 2014/0105779 A1 Apr. 17, 2014

(30) Foreign Application Priority Data

Oct. 17, 2012 (JP) ..... 2012-229999

(51) Int. Cl.

| | |
|---|---|
| ***H01F 41/02*** | (2006.01) |
| ***H01F 1/01*** | (2006.01) |
| ***H01F 1/057*** | (2006.01) |
| ***C22C 38/00*** | (2006.01) |

(52) U.S. Cl.

CPC ..... *H01F 41/0266* (2013.01); *C22C 38/005* (2013.01); *H01F 1/01* (2013.01); *H01F 1/0572* (2013.01); *H01F 1/0573* (2013.01); *H01F 41/0273* (2013.01); *H01F 1/0577* (2013.01)

(58) Field of Classification Search

CPC ..... C22C 38/005; H01F 1/01; H01F 1/0572; H01F 1/0573; H01F 1/0577; H01F 41/0266; H01F 41/0273; H01J 9/34

See application file for complete search history.

(56) References Cited

U.S. PATENT DOCUMENTS

| | | | | |
|---|---|---|---|---|
| 7,922,832 | B2 | 4/2011 | Nakamura et al. | |
| 7,955,443 | B2 | 6/2011 | Nakamura et al. | |
| 2013/0068992 | A1* | 3/2013 | Hono | C21D 6/00 252/62.55 |

FOREIGN PATENT DOCUMENTS

| | | | |
|---|---|---|---|
| EP | 0304054 | A2 | 2/1989 |
| EP | 0633581 | A1 | 1/1995 |
| JP | 2012-049492 | A | 3/2012 |
| JP | 2012049492 | A * | 3/2012 |
| WO | 2011/145674 | A1 | 11/2011 |

(Continued)

OTHER PUBLICATIONS

Y. Une et al , "Enhancement of Coercivity of Nd—Fe—B Sintered Magnets by Grain Size Reduction", J. Japan Inst. Metals, vol. 76, No. 1, pp. 12-16, (2012), English Translation.

(Continued)

*Primary Examiner* — Jessee Roe
*Assistant Examiner* — Anthony Liang
(74) *Attorney, Agent, or Firm* — Westerman, Hattori, Daniels & Adrian, LLP

(57) ABSTRACT

A strip cast alloy containing Nd in excess of the stoichiometry of $Nd_2Fe_{14}B$ is subjected to HDDR treatment and diffusion treatment, yielding microcrystalline alloy powder in which major phase crystal grains with a size of 0.1-1 μm are surrounded by Nd-rich grain boundary phase with a width of 2-10 nm. The powder is finely pulverized, compacted, and sintered, yielding a sintered magnet having a high coercivity.

18 Claims, 5 Drawing Sheets

(56) References Cited

FOREIGN PATENT DOCUMENTS

WO 2012/090765 A1 7/2012

OTHER PUBLICATIONS

Extended European Search Report dated Feb. 21, 2014, issued in corresponding European Patent Application No. 13189059.2 (7 pages).
Y. Une et al., "Enhancement of Coercivity of Nd—Fe—B Sintered Magnets by Grain Size Reduction", J. Japan Inst. Metals, vol. 76, No. 1, 2012, pp. 12-16.
A. F. Wilson et al., "The Rapid Heat Treatment of HDDR Compacts", The proceedings of 13th Int., Workshop on RE Magnets & Their Applications, 1994, pp. 563-572.
Y Xiao et al., "The Study of Phase Transformation During HDDR Process in Nd14Fe73Co6B7", The proceeding of 12th Int., Workshop on RE Magnets & Their Applications, 1992, pp. 258-265.
C. Burkhardt et al., "Optimisation of the HDDR proceeding temperature for co-reduced Nd—Fe—B powder with Zr additions", The proceedings of 13th Int., Workshop on RE Magnets & Their Applications 1994, pp. 473-481.
O. Gutfleisch et al., "Electron Microscopy Characterisation of a Solid-HDDR Processed Nd16Fe76B8 Alloy", The Proceedings of 8th Int. Symposium on Magnetic Anisotropy and Coercivity in Rare Earth-Transition Metal Alloys, 1994, pp. 243-252.

* cited by examiner

RARE EARTH SINTERED MAGNET AND MAKING METHOD

CROSS-REFERENCE TO RELATED APPLICATION

This non-provisional application claims priority under 35 U.S.C. §119(a) on Patent Application No. 2012-229999 filed in Japan on Oct. 17, 2012, the entire contents of which are hereby incorporated by reference.

TECHNICAL FIELD

This invention relates to high-performance rare earth sintered magnets with minimal contents of expensive Tb and Dy, and a method for preparing the same.

BACKGROUND ART

Over the years, Nd—Fe—B sintered magnets find an ever increasing range of application including hard disk drives, air conditioners, industrial motors, power generators and drive motors in hybrid cars and electric vehicles. When used in air conditioner compressor motors, vehicle-related components and other applications which are expected of future development, the magnets are exposed to elevated temperatures. Thus the magnets must have stable properties at elevated temperatures, that is, heat resistance. The addition of Dy and Tb is essential to this end whereas a saving of Dy and Tb is an important task when the tight resource problem is considered. For those magnets of the relevant composition which are expected to find ever increasing applications, it is desired to reduce the amount of Dy or Tb to a minimal level or even to zero.

For the relevant magnet based on the magnetism-governing major phase of $Nd_2Fe_{14}B$ crystal grains, small domains which are reversely magnetized, known as reverse magnetic domains, are created at interfaces of $Nd_2Fe_{14}B$ crystal grains. As these domains grow, magnetization is reversed. In theory, the maximum coercivity is equal to the anisotropic magnetic field (6.4 MA/m) of $Nd_2Fe_{14}B$ compound. However, because of a reduction of the anisotropic magnetic field caused by disorder of the crystal structure near grain boundaries and the influence of leakage magnetic field caused by morphology or the like, the coercivity actually available is only about 15% (1 MA/m) of the anisotropic magnetic field. Although this coercivity is of low value, the presence of a Nd-rich phase surrounding crystal grains is essential to develop such a value of coercivity. Therefore, in preparing sintered magnets, an alloy composition containing rare earth element in excess of the stoichiometric Nd content (11.76 at %) of $Nd_2Fe_{14}B$ compound is used. Although part of excessive rare earth element acts as a getter for oxygen and other impurity elements which are incidentally introduced during the preparation process, the majority surrounds major phase crystal grains as a Nd-rich phase and contributes to development of coercivity. Further, since the Nd-rich phase is liquid at the sintering temperature, the relevant composition magnets undergo further consolidation via liquid phase sintering. This indicates sinterability at a relatively low temperature, and the presence of a hetero-phase at grain boundaries is effective for suppressing major phase crystal grains from growing.

It is empirically known that a magnet of the above composition is increased in coercivity by reducing the size of $Nd_2Fe_{14}B$ particles as the major phase while maintaining the crystal morphology of the composition. The method of preparing a sintered magnet includes a finely pulverizing step, through which a magnet material is typically pulverized into a powder with an average particle size of about 3 to 5 μm. If the particle size is reduced to 1 to 2 μm, then the crystal grains in the sintered body are also reduced in size. As a result, the coercivity is increased to about 1.6 MA/m. See Non-Patent Document 1.

In fact, apart from the sintered magnets, Nd—Fe—B magnet powders, which are prepared by the melt quenching process or HDDR (hydrogenation-disproportionation-desorption-recombination) process, are composed of submicron crystal grains with a grain size of up to 1 μm. Some of them exhibit a higher coercivity than the sintered magnets when compared for the Dy or Tb-free composition. This fact suggests that size reduction of crystal grains leads to an increase of coercivity.

The only one means for obtaining such submicron crystal grains in the sintered magnet which has been discovered thus far is to reduce the powder particle size during the finely pulverizing step as reported in Non-Patent Document 1. If Nd—Fe—B alloy is pulverized into a fine powder, the powder is liable to oxidation because of highly active Nd, even with the danger of ignition. When magnet manufacture is carried out under such conditions as to have an average particle size of 3 to 5 μm, a suitable measure is taken for the duration from the fine pulverizing step to the sintering step. For example, the atmosphere is filled with an inert gas to avoid contact with oxygen, or the fine powder is mixed with oil to avoid contact of the powder with the ambient air. However, the particle size that can be reached by fine pulverization is limited to the order of 1 μm, and no guideline for obtaining crystal particles finer than this limit is available in the art.

On the other hand, the above-mentioned HDDR process is intended to gain a coercivity by heating a cast Nd—Fe—B alloy in hydrogen atmosphere at 700 to 800° C., and subsequently heat treating in vacuum, thereby changing the alloy structure from the crystal grains in the cast alloy having a size of several hundreds of microns (μm) to a collection of submicron crystal grains having a size of 0.2 to 1 μm. In the HDDR process, the $Nd_2Fe_{14}B$ compound as major phase undergoes disproportionation reaction with hydrogen in the hydrogen atmosphere, whereby it disproportionates into three phases, $NdH_2$, Fe, and $Fe_2B$. Via the subsequent vacuum heat treatment for hydrogen desorption, the three phases are recombined into the original $Nd_2Fe_{14}B$ compound. During the process, submicron crystal grains having a size of up to 1 μm are obtainable. Also, the HDDR process enables size reduction, depending on a particular composition or processing conditions, while the crystallographic orientation of submicron crystal grains is kept substantially the same as the crystallographic orientation of initial coarse crystal grains. Thus an anisotropic powder with a high magnetic force is obtainable. However, generally a hetero-phase (compound phase of heterogeneous composition) which is wider than a certain value (e.g., a width of at least 2 nm) does not exist between submicron crystal grains. This allows for grain growth to readily take place if the heat treatment temperature for recombination is high only slightly. Then high coercivity is not available. Although the HDDR powder is typically mixed with resins to form bonded magnets, an attempt to form a full-dense magnet has been made to produce a high magnetic force equivalent to sintered magnets. Most research works utilize the hot pressing step of compressing the powder while applying heat at substantially the same temperature as the HDDR process temperature, as described in Patent Document 1. However, this process has not been implemented in the industry because of extremely low productivity.

Other attempts are known from Non-Patent Document 2, for example, brief sintering by electric conduction sintering and sintering of a dense mass which is obtained by consolidating the HDDR powder in a rotary forging machine. Allegedly, the electric conduction sintering results in a variation in density of a sintered body, and the forging/sintering process allows for significant grain growth. It is thus believed difficult to form a full-dense magnet by sintering the HDDR powder.

CITATION LIST

Patent Document 1: JP-A 2012-049492

Non-Patent Document 1: Une and Sagawa, "Enhancement of Coercivity of Nd—Fe—B Sintered Magnets by Grain Size Reduction," J. Japan Inst. Metals, Vol. 76, No. 1, pp. 12-16 (2012)

Non-Patent Document 2: Wilson, Williams, Manwarning, Keegan, and Harris, "The Rapid Heat Treatment of HDDR Compacts," The proceedings of 13th Int. Workshop on RE Magnets & Their Applications, pp. 563-572 (1994)

Non-Patent Document 3: Xiao, Liu, Qiu and Lis, "The Study of Phase Transformation During HDDR Process in $Nd_{14}Fe_{73}Co_6B_7$," The proceedings of 12th Int. Workshop on RE Magnets & Their Applications, pp. 258-265 (1992)

Non-Patent Document 4: Burkhardt, Steinhorst and Harris, "Optimisation of the HDDR processing temperature for co-reduced Nd—Fe—B powder with Zr additions," The proceedings of 13th Int. Workshop on RE Magnets & Their Applications, pp. 473-481 (1994)

Non-Patent Document 5: Gutfleisch, Martinez, and Harris, "Electron Microscopy Characterisation of a Solid-HDDR Processed $Nd_{16}Fe_{76}B_8$ Alloy," The proceedings of 8th Int. Symposium on Magnetic Anisotropy and Coercivity in Rare Earth-Transition Metal Alloys, pp. 243-252 (1994)

SUMMARY OF INVENTION

An object of the invention is to provide a method for preparing a R—Fe—B type rare earth sintered magnet (wherein R is an element or a combination of two or more elements selected from rare earth elements inclusive of Sc and Y and essentially contains Nd and/or Pr), which magnet has a minimal or zero content of very rare Tb and Dy and high heat resistance; and a rare earth sintered magnet prepared by the method.

Non-Patent Document 3 reports that on HDDR treatment of a cast alloy containing a stoichiometric excess of Nd, in proximity to Nd-rich phase sparsely distributed in the cast alloy, constituents of Nd-rich phase undergo, though partially, grain boundary diffusion to surround submicron crystal grains of $Nd_2Fe_{14}B$, approaching to the morphology of grain boundary phase in sintered magnets. Similar structural morphologies are reported in Non-Patent Documents 4 and 5.

In Nd—Fe—B type alloys, the cast structure assumes the structural morphology that a small amount of Nd-rich phase is present among coarse grains of $Nd_2Fe_{14}B$ having a grain size ranging from 50 μm to several hundreds of microns, though depending on the cooling rate during casting. Accordingly, it is only around Nd-rich phase sparsely distributed in the cast alloy that assumes the morphology that Nd-rich phase surrounds $Nd_2Fe_{14}B$ grains along grain boundaries after the HDDR treatment. Also, the cast structure may have primary crystal α-Fe left therein, which causes to degrade magnetic properties. Therefore, the cast alloy is subjected to homogenization treatment at 800 to 1,000° C. to extinguish α-Fe. Since grain growth of both $Nd_2Fe_{14}B$ phase and Nd-rich phase occurs during the treatment, segregation of Nd-rich phase becomes outstanding.

On the other hand, a method of preparing alloy by strip casting is utilized for enhancing the performance of sintered magnets. The strip casting method involves casting a metal melt onto a rotating copper roll for quenching, obtaining an ingot in the form of a thin ribbon of 0.1 to 0.5 mm thick. Since the alloy is very brittle, actually flake alloy is obtained. The alloy obtained from this method has a very fine structure as compared with ordinary cast alloys, and a fine dispersion of Nd-rich phase. This improves the dispersion of liquid phase during the magnet sintering step and thus leads to enhancement of magnet properties.

The inventors have found that when a strip cast alloy of the composition containing Nd in excess of the stoichiometry of $Nd_2Fe_{14}B$ is subjected to HDDR process to convert the alloy to anisotropic polycrystalline powder, and the powder is held at a temperature approximate to the HDDR process temperature, constituents of finely dispersed Nd-rich phase undergo uniform grain boundary diffusion around $Nd_2Fe_{14}B$ crystal grains; and that when the powder is finely pulverized, compacted in a magnetic field, and sintered, a sintered magnet consisting of submicron crystal grains and having a high coercivity can be prepared because major phase crystal grains are surrounded by the Nd-rich phase which inhibits outstanding grain growth. The invention is predicated on this discovery.

In one aspect, the invention provides a method for preparing a R—Fe—B rare earth sintered magnet comprising $Nd_2Fe_{14}B$ crystal phase as major phase wherein R is an element or a combination of two or more elements selected from rare earth elements inclusive of Sc and Y and essentially contains Nd and/or Pr. The method comprises step (A) of preparing a microcrystalline alloy powder, step (A) including sub-step (a) of strip casting an alloy having the composition $R^1{}_aT_bM_cA_d$ wherein $R^1$ is an element or a combination of two or more elements selected from rare earth elements inclusive of Sc and Y and essentially contains Nd and/or Pr, T is Fe or Fe and Co, M is a combination of two or more elements selected from the group consisting of Al, Cu, Zn, In, P, S, Ti, Si, V, Cr, Mn, Ni, Ga, Ge, Zr, Nb, Mo, Pd, Ag, Cd, Sn, Sb, Hf, Ta, and W and essentially contains Al and Cu, A is B (boron) or B and C (carbon), "a" to "d" indicative of atomic percent in the alloy are in the range: $12.5 \le a \le 18$, $0.2 \le c \le 10$, $5 \le d \le 10$, and the balance of b, and consisting essentially of crystal grains of $Nd_2Fe_{14}B$ crystal phase and precipitated grains of $R^1$-rich phase, the grains of $R^1$-rich phase being precipitated in such a distribution that the average distance between precipitated grains is up to 20 μm, sub-step (b) of HDDR treatment of heating the strip cast alloy in hydrogen atmosphere at 700 to 1,000° C. to induce disproportionation reaction to disproportionate the $Nd_2Fe_{14}B$ crystal phase into $R^1$ hydride, Fe, and $Fe_2B$, then heating the alloy under a reduced hydrogen partial pressure at 700 to 1,000° C. to recombine them into $Nd_2Fe_{14}B$ crystal phase, for thereby forming submicron crystal grains having an average grain size of 0.1 to 1 μm, sub-step (c) of diffusion treatment of heating the HDDR-treated alloy in vacuum or in an inert gas atmosphere at a temperature of 600 to 1,000° C. for a time of 1 to 50 hours, for thereby preparing a microcrystalline alloy powder consisting essentially of submicron crystal grains of $Nd_2Fe_{14}B$ crystal phase having an average grain size of 0.1 to 1 μm and $R^1$-rich grain boundary phase surrounding the submicron crystal grains across an average width of 2 to 10 nm, step (B) of pulverizing the microcrystalline alloy powder into a fine powder, step (C) of compacting the fine powder in a magnetic field into a green compact, and step (D) of heating the green compact in vacuum or in an inert gas atmosphere at 900 to 1,100° C. for sintering, thereby yielding a R—Fe—B rare earth sintered magnet having an average grain size of 0.2 to 2 μm.

In a preferred embodiment, the method further comprises step (A') of mixing more than 0% to 15% by weight of an auxiliary alloy powder with the microcrystalline alloy powder of step (A) between steps (A) and (B). The auxiliary alloy has the composition $R^2{}_eK_f$ wherein $R^2$ is an element or a combination of two or more elements selected from rare earth elements inclusive of Sc and Y and essentially contains at least one element selected from among Nd, Pr, Dy, Tb and Ho, K is an element or a combination of two or more elements selected from the group consisting of Fe, Co, Al, Cu, Zn, In, P, S, Ti, Si, V, Cr, Mn, Ni, Ga, Ge, Zr, Nb, Mo, Pd, Ag, Cd, Sn, Sb, Hf, Ta, W, H, and F, e and f indicative of atomic percent in the alloy are in the range: 20 e 95 and the balance of f. In this embodiment, step (B) is by pulverizing the mixture of the microcrystalline alloy powder and the auxiliary alloy powder into a fine powder.

Preferably, $R^1$ in the composition of the microcrystalline alloy powder contains at least 80 at % of Nd and/or Pr based on all $R^1$; and T in the composition of the microcrystalline alloy powder contains at least 85 at % of Fe based on all T. Notably, "at %" is atomic percent.

Preferably, the sintering step (D) may be followed by heat treatment at a temperature lower than the sintering temperature.

Also contemplated herein is a rare earth sintered magnet which is prepared by the method defined above.

Advantageous Effects of Invention

According to the invention, R—Fe—B type rare earth sintered magnets with a minimal or zero content of Tb and Dy are obtained, the magnets featuring high performance.

DESCRIPTION OF PREFERRED EMBODIMENTS

It is now described how to prepare rare earth sintered magnets according to the invention. The invention relates to a method for preparing a R—Fe—B type rare earth sintered magnet comprising Nd $Fe_{14}B$ crystal phase as major phase wherein R is an element or a combination of two or more elements selected from rare earth elements inclusive of Sc and Y and essentially contains Nd and/or Pr. The method starts with step (A) of preparing a microcrystalline alloy powder. Step (A) includes providing a strip cast alloy (also referred to as mother alloy) of the composition containing R in excess of the stoichiometry of $R_2Fe_{14}B$, subjecting the strip cast alloy to HDDR process and then to diffusion heat treatment. In this way, the microcrystalline alloy powder is obtained in which R-rich grain boundary phase is present so as to surround submicron crystal grains of $R_2Fe_{14}B$ major phase with an average grain size of 0.1 to 1 μm. The microcrystalline alloy powder is then subjected to the steps of coarse pulverizing, fine pulverizing, compaction and sintering, thereby yielding a R—Fe—B type rare earth sintered magnet having an average grain size of 0.2 to 2 μm. The method is preferably implemented in two embodiments.

First Embodiment

Figure 1:
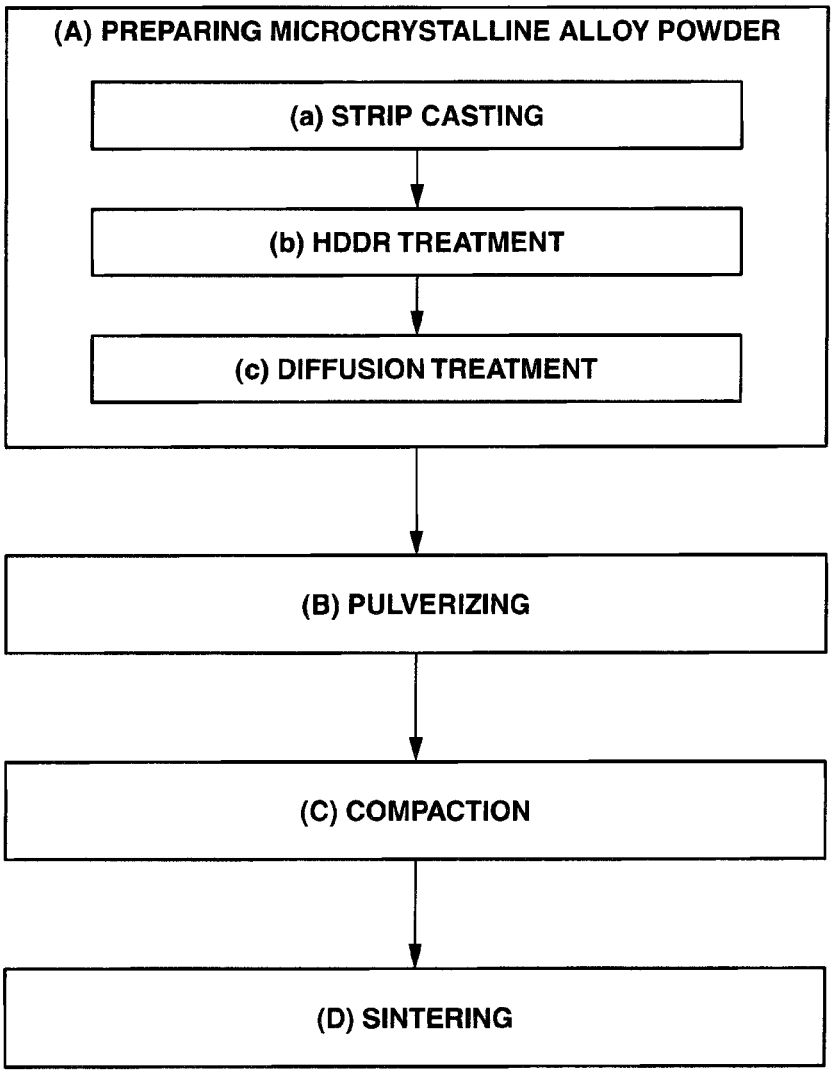
FIG. 1 is a flow chart showing a method for preparing a rare earth sintered magnet in a first embodiment of the invention.

FIG. 1 is a flow chart showing how to prepare a rare earth sintered magnet in a first embodiment of the invention. In the first embodiment shown in FIG. 1, the method for preparing a rare earth sintered magnet involves step (A) of preparing a microcrystalline alloy powder via sub-step (a) of strip casting, sub-step (b) of HDDR treatment, and sub-step (c) of diffusion treatment, step (B) of pulverizing the microcrystalline alloy powder into a fine powder, step (C) of compacting the fine powder in a magnetic field into a green compact, and step (D) of sintering the green compact. These steps are described in detail below.

Step (A) of Preparing Microcrystalline Alloy Powder

Step (A) is to prepare a microcrystalline alloy powder via sub-step (a) of strip casting an alloy having the composition $R^1{}_aT_bM_cA_d$ (wherein $R^1$ is an element or a combination of two or more elements selected from rare earth elements inclusive of Sc and Y and essentially contains Nd and/or Pr, T is Fe or Fe and Co, M is a combination of two or more elements selected from the group consisting of Al, Cu, Zn, In, P, S, Ti, Si, V, Cr, Mn, Ni, Ga, Ge, Zr, Nb, Mo, Pd, Ag, Cd, Sn, Sb, Hf, Ta, and W and essentially contains Al and Cu, A is B (boron) or B and C (carbon), "a" to "d" indicative of atomic percent in the alloy are in the range: $12.5 \le a \le 18$, $0.2 \le c \le 10$, $5 \le d \le 10$, and the balance of b), sub-step (b) of subjecting the strip cast alloy to HDDR treatment, sub-step (c) of subjecting the HDDR-treated alloy to diffusion treatment at a temperature not higher than the temperature of HDDR treatment, for thereby preparing a microcrystalline alloy powder consisting essentially of submicron crystal grains of Nd $Fe_{14}B$ crystal phase having an average grain size of 0.1 to 1 μm and $R^1$-rich grain boundary phase surrounding the submicron crystal grains across an average width of 2 to 10 nm. In the disclosure, the strip cast alloy is also referred to as "mother alloy."

In the mother alloy composition, $R^1$ is an element or a combination of two or more elements selected from rare earth elements inclusive of Sc and Y, specifically from the group consisting of Sc, Y, La, Ce, Pr, Nd, Sm, Eu, Gd, Tb, Dy, Ho, Er, Yb, and Lu, and essentially contains Nd and/or Pr. It is essential that the rare earth element(s) inclusive of Sc and Y be contained in a level higher than the R content (=11.765 at %) in the stoichiometry of $R_2Fe_{14}B$ compound serving as major phase, preferably in a content of 12.5 to 18 at %, more preferably 13 to 16 at % of the alloy.

Also preferably, $R^1$ contains at least 80 at %, more preferably at least 85 at % of Nd and/or Pr based on all $R^1$.

T is Fe or a mixture of Fe and Co. Preferably, T contains at least 85 at %, more preferably at least 90 at % of Fe based on all T.

M is a combination of two or more elements selected from the group consisting of Al, Cu, Zn, In, P, S, Ti, Si, V, Cr, Mn, Ni, Ga, Ge, Zr, Nb, Mo, Pd, Ag, Cd, Sn, Sb, Hf, Ta, and W, and essentially contains Al and Cu. M is preferably present in an amount of 0.2 to 10 at %, more preferably 0.25 to 4 at % of the entire alloy.

A is B (boron) or a mixture of B (boron) and C (carbon). A is preferably present in an amount of 5 to 10 at %, more preferably 5 to 7 at % of the entire alloy. Preferably, A contains at least 60 at %, more preferably at least 80 at % of B (boron) based on all A.

It is noted that the balance of the alloy composition consists of incidental impurities such as N (nitrogen), 0 (oxygen), F (fluorine), and H (hydrogen).

Sub-Step (a): Strip Casting

Figure 2:
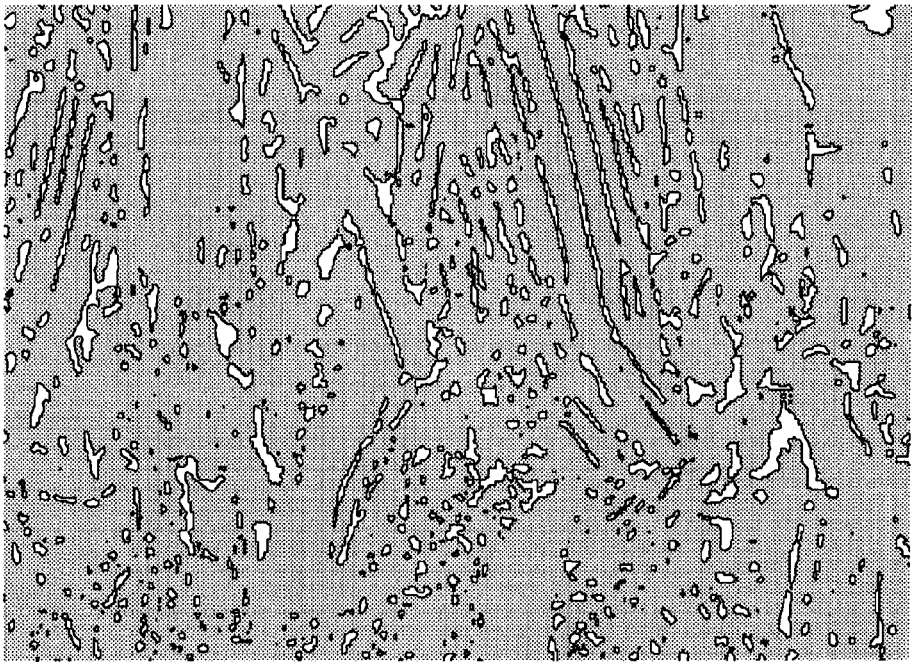
FIG. 2 schematically illustrates the crystal structure of strip cast alloy according to the invention.

The mother alloy is obtained by melting raw material metals or alloys in accordance with the above-mentioned alloy composition in vacuum or in an inert gas, preferably Ar atmosphere, and casting the melt by the strip casting method. The strip casting method involves casting the melt of the alloy composition onto a copper chill roll for quenching, obtaining a thin ribbon of alloy. The flake alloy obtained from this method has a crystalline structure in which precipitated grains of $R^1$-rich phase containing $R^1$ in excess of the stoichiometry of $R^1{}_2Fe_{14}B$ compound are finely dispersed among crystal grains of $R^1{}_2Fe_{14}B$ major phase. Preferably the distance between adjacent precipitated grains of $R^1$-rich phase is on average up to 20 μm, more preferably up to 10 μm, and even more preferably up to 5 μm. The crystalline structure of the strip cast alloy according to the invention is illustrated by the schematic view of FIG. 2. In the view, the $R^1{}_2Fe_{14}B$ compound is depicted as gray contrast areas whereas the precipitated grains of $R^1$-rich phase is depicted as white contrast areas.

It is noted that the average distance between precipitated grains is determined by taking a reflection electron image of a mirror finished cross-section of the strip cast alloy, measuring the distance between 50 to 200 pairs of most adjacent grains picked up from precipitated grains of $R^1$-rich grain boundary phase depicted as bright contrast areas, and computing an average value. The same applies to Examples to be described later.

In the mother alloy, the dispersion state of precipitated grains of $R^1$-rich phase is important since it affects the diffusion state of $R^1$-rich phase achieved by the subsequent diffusion treatment following HDDR treatment. For example, in the conventional melting and casting method of casting the melt in a flat mold or book mold, a slow cooling rate leads to a low degree of undercooling and formation of less nuclei. Since these nuclei grow to coarse grains, the dispersed state of precipitated grains of $R^1$-rich phase is coarse. Thus the distance between precipitated grains of $R^1$-rich phase is on average about 50 to 200 μm. If the average distance between precipitated grains of $R^1$-rich phase exceeds 50 μm, the extent or distance over which the $R^1$-rich phase is grain boundary diffused is limitative, and as a result, there is left a region where the $R^1$-rich grain boundary phase is absent at the major phase crystal grain boundary between precipitated grains (that is, the region where the width of grain boundary phase is so narrow that major phase crystal grains are close to each other). Grain growth occurs in this region during the sintering step. It is then impossible to manufacture high-performance sintered magnets desired herein. Furthermore, as the $R^1$ amount is smaller, primary crystal α-Fe is more likely to remain, leading to degradation of magnetic properties. Meanwhile, if a homogenization treatment at 800 to 1,000° C. is carried out to extinguish α-Fe, major phase crystal grains and precipitated grains of $R^1$-rich phase undergo grain growth and as a result, the distance between precipitated grains becomes as long as 300 to 1,000 μm. Since further grain growth of major phase crystal grains occurs during the sintering step, it is difficult to manufacture high-performance sintered magnets. In contrast, the strip casting method ensures that the distance between adjacent precipitated grains of $R^1$-rich phase is on average up to 20 μm. The precipitated grains of $R^1$-rich phase in such a dispersion state can be converted through diffusion treatment to $R^1$-rich grain boundary phase surrounding submicron crystal grains across an average width of 2 to 10 nm. As a result, grain growth of major phase crystal grains during the sintering step can be suppressed. It is noted that the melt spinning method is unsuitable despite a higher cooling rate, because under ordinary cooling conditions, the spun product is an isotropic body having an average grain size of up to 100 μm and random crystallographic orientation, which cannot be aligned in a magnetic field during the subsequent step of compaction in a magnetic field, resulting in a magnet with a low remanence (residual magnetic flux density).

For these reasons, it is essential in the practice of the invention to prepare the mother alloy by the strip casting method.

Sub-Step (b): HDDR Treatment

The mother alloy is converted into submicron crystal grains with an average grain size of 0.1 to 1 μm through the HDDR treatment involving disproportionation reaction on the mother alloy in hydrogen atmosphere, subsequent hydrogen desorption, and recombination reaction. Although the profile of the HDDR treatment (including temperature and atmosphere conditions) may be as usual, it is desirable to select such conditions as to produce anisotropic grains. This is because if submicron crystal grains resulting from recombination are isotropic, they cannot be oriented in a magnetic field during the subsequent step of compaction in a magnetic field. One example is described below.

First, the strip cast alloy (mother alloy) is admitted in a furnace whose atmosphere may be vacuum or an inert gas atmosphere such as argon when the alloy is heated from room temperature to 300° C. If the atmosphere contains hydrogen in this temperature range, hydrogen atoms are taken in between lattices of $R_2Fe_{14}B$ compound, the magnet is expanded in volume, and unnecessary disruption occurs in the alloy. The vacuum or inert gas atmosphere is effective for preventing such disruption. If it is desired to utilize such disruption for improvement in efficiency of the subsequent fine pulverizing step, the atmosphere may have a hydrogen partial pressure of about 100 kPa.

Next, in the temperature range from 300° C. to the treatment temperature (700 to 1,000° C.), heating is preferably carried out under a hydrogen partial pressure of lower than 100 kPa, depending on the alloy composition and heating rate. The pressure is limited for the following reason. If heating is carried out under a hydrogen partial pressure in excess of 100 kPa, disproportionation reaction of $R_2Fe_{14}B$ compound starts during the heating step (at 600 to 700° C., depending on the magnet composition). With the increasing temperature, the disproportionated structure grows to a coarse globular one. This may prevent anisotropic conversion upon recombination into $R_2Fe_{14}B$ compound during subsequent hydrogen desorption treatment.

Once the treatment temperature is reached, the hydrogen partial pressure is increased to or above 100 kPa, depending on the magnet composition. The magnet is maintained in these conditions for 10 minutes to 10 hours to induce disproportionation reaction to the $R_2Fe_{14}B$ compound. As to the reason of limitation of time, a time of at least 10 minutes is set because otherwise disproportionation reaction does not fully proceed so that unreacted coarse $R_2Fe_{14}B$ compound is left as well as the products $RH_2$, α-Fe and $Fe_2B$. A time of up to 10 hours is set because if heat treatment is continued over a long time, inevitable oxidation occurs to degrade magnetic properties. A time of 30 minutes to 5 hours is preferred. During the isothermal treatment, the hydrogen partial pressure is preferably increased stepwise. If the hydrogen partial pressure is increased straight rather than stepwise, the reaction takes place too rapidly so that the disproportionated structure becomes non-uniform, and the grain size then becomes non-uniform upon recombination into $R_2Fe_{14}B$ compound during the subsequent hydrogen desorption, resulting in a decline of coercivity or squareness.

Subsequently, the hydrogen partial pressure in the furnace is reduced to or below 10 kPa for desorption of hydrogen from within the alloy. The hydrogen partial pressure is adjusted by continuing evacuation of the vacuum pump with a reduced capacity or by adding argon gas flow. At this point, $R_2Fe_{14}B$ phase is formed at the interface between $RH_2$ phase and α-Fe phase and with the same crystallographic orientation as the original coarse $R_2Fe_{14}B$ phase. It is preferred to run mild reaction while maintaining the hydrogen partial pressure over a certain range, as alluded to previously. If the pressure is straight reduced to the full capacity of the vacuum pump, the driving force of recombination reaction becomes too strong, whereby too many $R_2Fe_{14}B$ phase nuclei having random crystal orientation form, with the degree of orientation of the collective structure being reduced. Finally the atmosphere is switched to a vacuum evacuated atmosphere (equal to or below 1 Pa) for the reason that if hydrogen is finally left in the alloy, diffusion is inhibited during the subsequent diffusion step by a shortage of liquidus quantity.

The total time of treatment in both reduced pressure hydrogen atmosphere and vacuum evacuated atmosphere is preferably 5 minutes to 49 hours. In less than 5 minutes, recombination reaction is not complete. If the time exceeds 49 hours, magnetic properties are degraded due to oxidation during long-term heat treatment.

Of these treatments, hydrogen desorption treatment may be performed at a temperature in the range of 700 to 1,000° C. and higher than the temperature of heat treatment in hydrogen, for the purpose of reducing the treatment time. Alternatively, hydrogen desorption treatment may be performed at a temperature lower than the temperature of heat treatment in hydrogen, for the purpose of promoting milder recombination reaction.

Sub-Step (c): Diffusion Treatment

The alloy which has been HDDR treated as mentioned above is subsequently subjected to diffusion treatment of $R^1$-rich phase. The heat treatment is performed at a temperature of 600 to 1,000° C. for a time of 1 to 50 hours in vacuum or an inert gas such as argon.

With respect to the treatment temperature, if the temperature is below 600° C., the $R^1$-rich phase remains solid phase so that little diffusion takes place. At a temperature equal to or higher than 600° C., the $R^1$-rich phase becomes liquid phase, allowing the $R^1$-rich phase to diffuse along grain boundaries of submicron $R_2Fe_{14}B$ crystal grains. On the other hand, if the temperature exceeds 1,000° C., the amount of Fe solid solution in the $R^1$-rich phase is rapidly increased, whereby the $R_2Fe_{14}B$ phase is dissolved away and the volume of the $R^1$-rich phase is rapidly increased. Although this may imply more efficient diffusion in that dissolution of grains widens the path for diffusion and increases the amount of diffusant, in fact, diffusion to grain boundaries is not promoted, as it is seen from the result of structure observation that this state helps agglomeration of $R^1$-rich phase. Accordingly, the upper limit of treatment temperature is 1,000° C.

With respect to the treatment time, if the time is shorter than 1 hour, diffusion does not fully proceed. If the time exceeds 50 hours, magnetic properties are degraded due to oxidation during long-term heat treatment. With the impact of oxidation taken into account, it is preferred that the total of previous vacuum evacuation time (5 minutes to 49 hours) plus diffusion treatment time do not exceed 50 hours.

The microcrystalline alloy thus obtained has a structural morphology consisting of $R_2Fe_{14}B$ grains (major phase crystal grains) having an average grain size of 0.1 to 1 μm and an aligned crystal orientation and an $R^1$-rich phase surrounding them across an average width of 2 to 10 nm, preferably 4 to 10 nm. After ordinary HDDR treatment (that is, HDDR treatment of mother alloy cast by the conventional casting method), the above-defined structural morphology is only locally formed, and grain boundary phase has a width of less than 2 nm or does not exist in most sites. That is, if a sintered magnet is manufactured using such an alloy containing $R^1$-rich grain boundary phase having an average width of less than 2 nm, the sintered body consisting of submicron crystal grains is not obtained because the said sites of grain boundary phase become the starting point of grain growth. Even when the average width of grain boundary phase is more than 2 nm, it is desirable that those local sites having a width of less than 2 nm are as few as possible. On the other hand, effective results are obtainable from an average width of up to 1,000 nm although it is difficult to achieve within the technical scope of the invention that the average width of $R^1$-rich grain boundary phase exceeds 10 nm. When it is desired to obtain an average width beyond the limit, the $R^1$ content in the alloy composition must be increased beyond the compositional range of the invention. However, the increased $R^1$ content is inconvenient because of concomitant drops of remanence and maximum energy product.

It is noted that the average grain size is determined as follows. First, a piece of microcrystalline alloy (or magnet) is polished to mirror finish and etched with an etchant to provide grain boundaries with a contrast (raised and recessed portions). An image of the alloy piece in an arbitrary field of view is taken under a scanning electron microscope (SEM). The area of individual grains is measured. The diameter of an equivalent circle is assumed to be the size of individual grains. A histogram indicative of a grain size distribution is drawn where relative to a certain grain size range, a proportion of the area occupied by crystal grains in the range instead of the number of crystal grains in the range is plotted. The area median grain size determined from this histogram is defined as the average grain size. The same applies to Examples to be described later.

Figure 3:
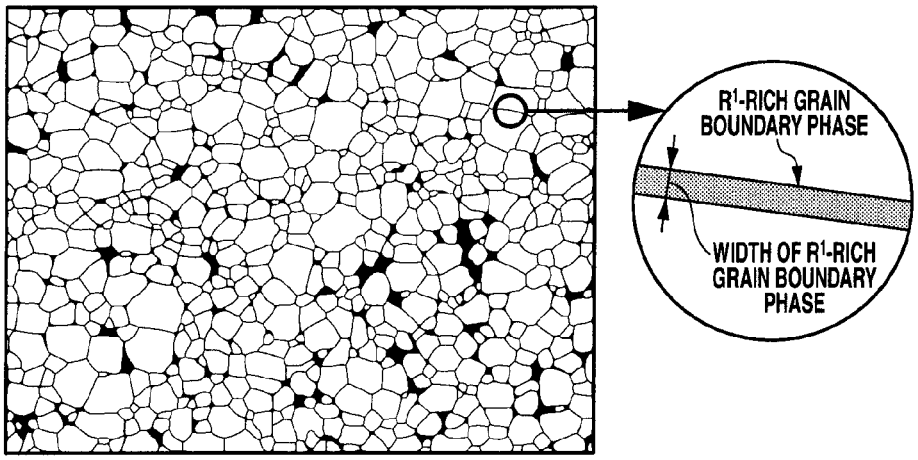
FIG. 3 schematically illustrates the crystal structure of alloy as diffusion treated according to the invention.

The average width of $R^1$-rich phase is determined as follows. After a thin piece of microcrystalline alloy is worked by mechanical polishing or ion milling, an image of the alloy piece in an arbitrary field of view is taken under a transmission electron microscope (TEM). The width of an arbitrary number (10 to 20) of grain boundary phase segments exclusive of the triplet where grain boundary phases gather together from three directions is measured. An average value is computed therefrom, which indicates the average width of $R^1$-rich phase. The same applies to Examples to be described later. FIG. 3 schematically illustrates the microscopic structure and grain boundary phase of the alloy after diffusion treatment.

Subsequently, the microcrystalline alloy is coarsely pulverized into a microcrystalline alloy powder with a weight average particle size of 0.05 to 3 mm, especially 0.05 to 1.5 mm. The coarse pulverizing step uses mechanical pulverization on a pin mill or hydrogen decrepitation.

Step (B) of Pulverization

The microcrystalline alloy powder is then finely milled, for example, on a jet mill using high-pressure nitrogen, into an anisotropic polycrystalline fine powder with a weight average particle size of 1 to 30 μm, especially 1 to 5 μm.

Step (C) of Compaction

The microcrystalline alloy fine powder thus obtained is introduced into a compactor where it is compression molded in a magnetic field into a green compact.

Step (D) of Sintering

The green compact is placed in a sintering furnace where it is sintered in vacuum or in an inert gas atmosphere typically at a temperature of 900 to 1,100° C., preferably 950 to 1,050° C.

The sintered magnet consists of 60 to 99% by volume, preferably 80 to 98% by volume of tetragonal $R_2Fe_{14}B$ compound as major phase with the balance consisting of 0.5 to 20% by volume of R-rich phase, 0 to 10% by volume of B-rich phase, and 0.1 to 10% by volume of R oxide and at least one of carbides, nitrides, hydroxides and fluorides of incidental impurities or a mixture or composite thereof. The magnet has a crystal structure in which major phase crystal grains have an average grain size of 0.2 to 2 μm.

Following the sintering step (D), heat treatment may be carried out at a lower temperature than the sintering temperature. That is, after the sintered block is optionally machined to the predetermined shape, diffusion treatment may be carried out by the well-known technology. Also, surface treatment may be carried out if necessary.

The rare earth sintered magnet thus obtained may be used as a high coercivity and high performance permanent magnet having a minimal or zero content of expensive Tb and Dy.

Second Embodiment

Described below is the second embodiment of the method for preparing rare earth sintered magnet according to the invention. The second embodiment is arrived at by applying the so-called two-alloy process to the first embodiment for the purpose of improving sinterability, specifically by preparing an auxiliary alloy containing 20 to 95 at % of a specific rare earth element, coarsely crushing the auxiliary alloy, mixing the coarse powder of the mother alloy with the coarse powder of the auxiliary alloy, finely milling the mixture, compaction and sintering.

Figure 4:
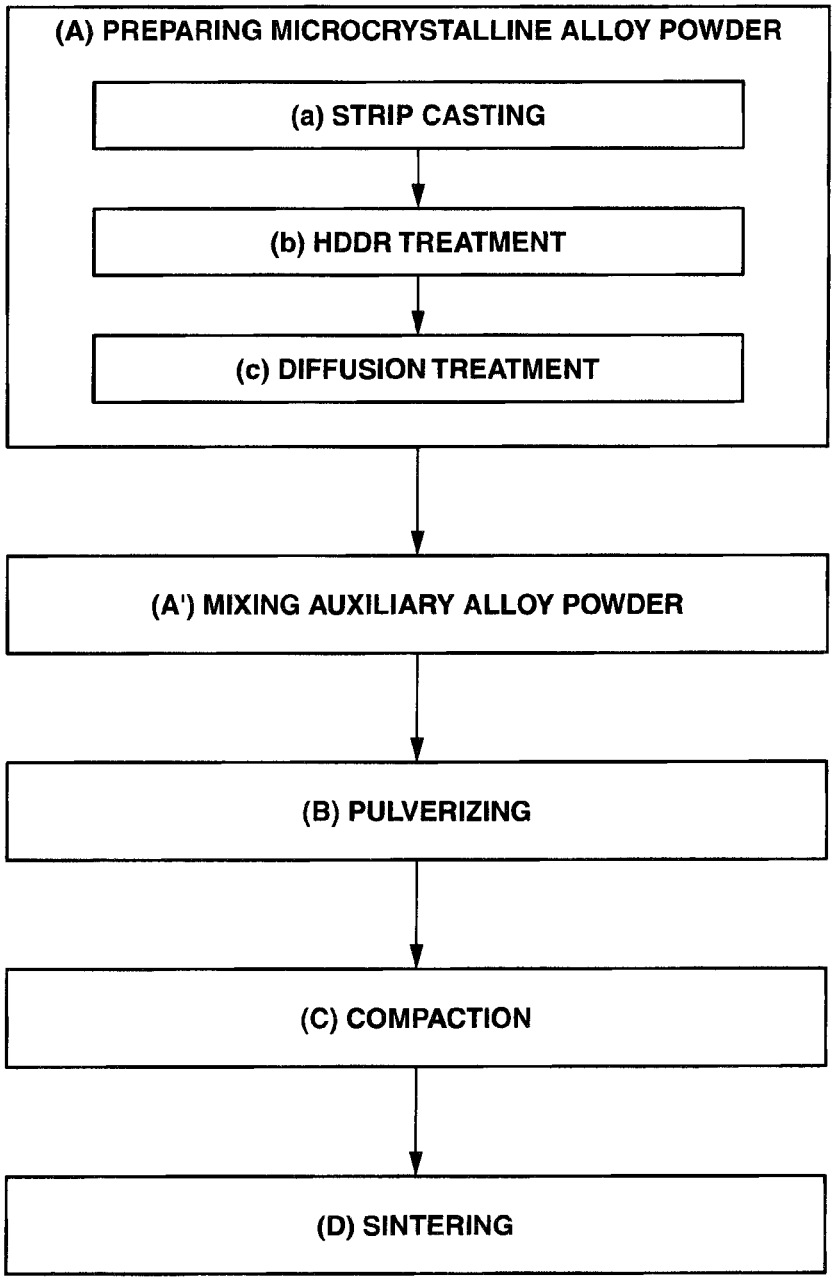
FIG. 4 is a flow chart showing a method for preparing a rare earth sintered magnet in a second embodiment of the invention.

FIG. 4 is a flow chart showing a method for preparing rare earth sintered magnet in the second embodiment of the invention, which differs from the flow chart (FIG. 1) of the first embodiment in that step (A') of mixing auxiliary alloy powder is included between steps (A) and (B).

Step (A') of Mixing Auxiliary Alloy Powder

The method involves step (A') of mixing more than 0% to 15% by weight of an auxiliary alloy powder with the microcrystalline alloy powder of step (A) between steps (A) and (B). The auxiliary alloy has the composition $R^2{}_eK_f$ wherein $R^2$ is an element or a combination of two or more elements selected from rare earth elements inclusive of Sc and Y and essentially contains at least one element selected from among Nd, Pr, Dy, Tb and Ho, K is an element or a combination of two or more elements selected from the group consisting of Fe, Co, Al, Cu, Zn, In, P, S, Ti, Si, V, Cr, Mn, Ni, Ga, Ge, Zr, Nb, Mo, Pd, Ag, Cd, Sn, Sb, Hf, Ta, W, H, and F, e and f indicative of atomic percent in the alloy are in the range: 20 e 95 and the balance of f.

It is preferred that $R^2$ in the composition of the auxiliary alloy contains at least 80 at %, especially at least 85 at % of Nd and/or Pr based on all $R^2$. K is selected as appropriate, depending on the desired magnetic and other properties of the sintered magnet and crushability. In the auxiliary alloy, incidental impurities such as N (nitrogen) and O (oxygen) may be contained in an amount of 0.01 to 3 at %.

For the preparation of the auxiliary alloy, the strip casting and melt quenching processes are applicable as well as the ordinary melting and casting process. Where K is H (hydrogen), hydrogen is absorbed in the cast alloy by exposing the alloy to hydrogen atmosphere and optionally heating at 100 to 300° C.

The step of coarsely crushing the auxiliary alloy into a powder may be mechanical crushing on a pin mill or the like or hydrogen decrepitation. Where K contains hydrogen, the above-mentioned hydrogen absorption treatment also serves as hydrogen decrepitation. In this way, the auxiliary alloy is coarsely crushed to a weight average particle size of 0.05 to 3 mm, especially 0.05 to 1.5 mm.

The auxiliary alloy powder is mixed with the microcrystalline alloy powder of step (A) in an amount of up to 15% by weight. If the amount of the auxiliary alloy powder mixed exceeds 15% by weight, it indicates an increase of non-ferromagnetic component in the magnet so that the magnetic properties may be degraded. It is understood that the addition of the auxiliary alloy is unnecessary if the microcrystalline alloy is derived from the mother alloy composition ensuring the inclusion of ample rare earth-rich phase.

Next the mixture of the microcrystalline alloy powder and the auxiliary alloy powder is finely milled into a fine powder. Fine milling may be performed, for example, on a jet mill using high-pressure nitrogen, as in the first embodiment, and preferably into an anisotropic polycrystalline fine powder with a weight average particle size of 1 to 30 μm, especially 1 to 5 μm. If the ease of milling largely differs between the microcrystalline alloy powder and the auxiliary alloy powder, they may be separately milled and thereafter mixed together.

Thereafter, the same steps as in the first embodiment are carried out to produce an R—Fe—B sintered magnet having an average grain size of 0.2 to 2 μm.

EXAMPLE

Examples are given below for further illustrating the invention although the invention is not limited thereto.

Example 1 and Comparative Example 1

A rare earth sintered magnet was prepared as follows. A ribbon form mother alloy consisting essentially of 14.5 at % Nd, 0.5 at % Al, 0.2 at % Cu, 0.1 at % Ga, 0.1 at % Zr, 6.2 at % B, and the balance of Fe was prepared by the strip casting technique, specifically by using Nd, Al, Cu, Zr, and Fe metals having a purity of at least 99 wt %, Ga having a purity of 99.9999 wt %, and ferroboron, high-frequency heating in an Ar atmosphere for melting, and casting the melt onto a single chill roll of copper. In the mother alloy thus obtained, the distance between precipitated grains (grain boundary phase) was 4 μm on average.

Figure 5:
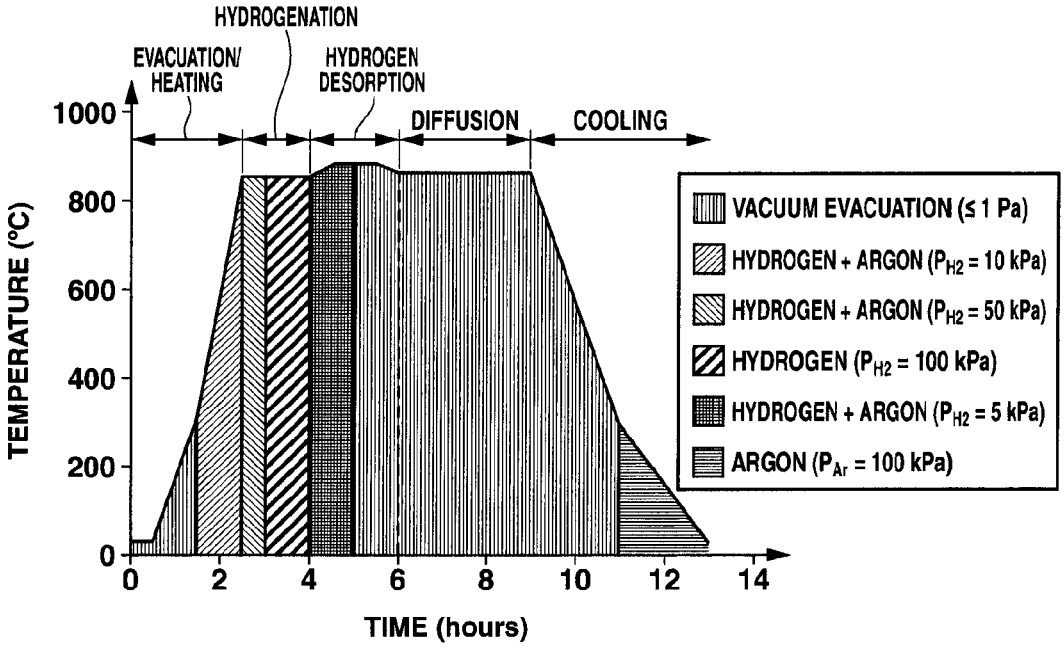
FIG. 5 is a diagram showing the heat treatment profile of HDDR and diffusion treatments in Examples 1 and 3.

The mother alloy was subjected to HDDR and diffusion treatments in accordance with the profile shown in FIG. 5. Specifically, the mother alloy was placed in a furnace where the atmosphere was evacuated to a vacuum of 1 Pa or below, and heating was started at the same time. When 300° C. was reached, a mixture of hydrogen and argon was fed into the furnace so as to establish a hydrogen partial pressure $P_{H2}$ of 10 kPa. The furnace was further heated to 850° C. Next, as hydrogenation treatment, with the temperature maintained, a mixture of hydrogen and argon was fed into the furnace so as to establish a hydrogen partial pressure $P_{H2}$ of 50 kPa (over 30 minutes), and subsequently only hydrogen was fed into the furnace so as to establish a hydrogen partial pressure $P_{H2}$ of 100 kPa (over 1 hour). Next, as hydrogen desorption, with the temperature elevated and held at 870° C., a mixture of hydrogen and argon was fed into the furnace so as to establish a hydrogen partial pressure $P_{H2}$ of 5 kPa (over 1 hour), and thereafter, with the gas feed interrupted, evacuation was performed to a vacuum of 1 Pa or below (over 1 hour). Then, as diffusion treatment, heating at 850° C. in vacuum was continued for 200 minutes. Subsequently, the alloy was cooled to 300° C. in vacuum, and finally, with argon gas fed, cooled to room temperature.

The series of heat treatments yielded a microcrystalline alloy in which major phase crystal grains had an average grain size of 0.3 μm and the grain boundary phase had an average width of 6 nm.

Next, the alloy was exposed to a hydrogen atmosphere of 0.11 MPa at room temperature for hydrogen absorption, heated up to 500° C. while vacuum pumping so that hydrogen was partially desorbed, cooled, and sieved, collecting a coarse powder under 50 mesh as microcrystalline alloy powder.

The microcrystalline alloy powder was finely pulverized on a jet mill using high-pressure nitrogen gas, into a fine powder having a weight average particle size of 4 μm. The fine powder was magnetized in a pulsed magnetic field of 50 kOe and compacted under a pressure of about 1 ton/cm$^2$ in a nitrogen atmosphere while being oriented in a magnetic field of 15 kOe. The green compact was then placed in a sintering furnace where it was sintered in argon atmosphere at 1,050° C. for 1 hour. It was further heat treated at 550° C. for 1 hour, yielding a sintered magnet block T1.

In Comparative Example 1, the HDDR and diffusion treatments of FIG. 5 were omitted. The strip cast alloy was treated in subsequent steps as in Example 1, yielding a usual sintered magnet block S1.

Table 1 tabulates the magnetic properties at room temperature and the average grain size of these magnet blocks. The magnetic properties were measured using a BH tracer having a maximum applied magnetic field of 1,989 kA/m. The average grain size was computed from a SEM image of a cross section of the magnet block.

TABLE 1

| | Remanence Br (T) | Coercivity Hcj (kA/m) | Maximum energy product $(BH)_{max}$ (kJ/m$^3$) | Average grain size (μm) |
|---|---|---|---|---|
| Example 1: T1 | 1.42 | 1488 | 394 | 0.9 |
| Comparative Example 1: S1 | 1.43 | 1003 | 404 | 5.6 |

It has been demonstrated that magnet block T1 produces a higher coercivity than magnet block S1 resulting from the conventional sintered magnet manufacturing method, by virtue of the crystal grain micronizing effect that the major phase crystal grains are previously micronized to 0.3 μm by the HDDR treatment, and their growth during the subsequent sintering step is fully restrained by the grain boundary phase with an average width of 6 nm which is created by the diffusion treatment.

Example 2 and Comparative Example 2

A rare earth sintered magnet was prepared as follows.

A ribbon form mother alloy consisting essentially of 12 at % Nd, 2.5 at % Pr, 0.3 at % Al, 0.15 at % Cu, 0.05 at % Ga, 0.08 at % Zr, 6.1 at % B, and the balance of Fe was prepared by the strip casting technique, specifically by using Nd, Pr, Al, Cu, Zr, and Fe metals having a purity of at least 99 wt %, Ga having a purity of 99.9999 wt %, and ferroboron, high-frequency heating in an Ar atmosphere for melting, and casting the melt onto a single chill roll of copper. In the mother alloy thus obtained, the distance between precipitated grains (grain boundary phase) was 3.7 μm on average.

Figure 6:
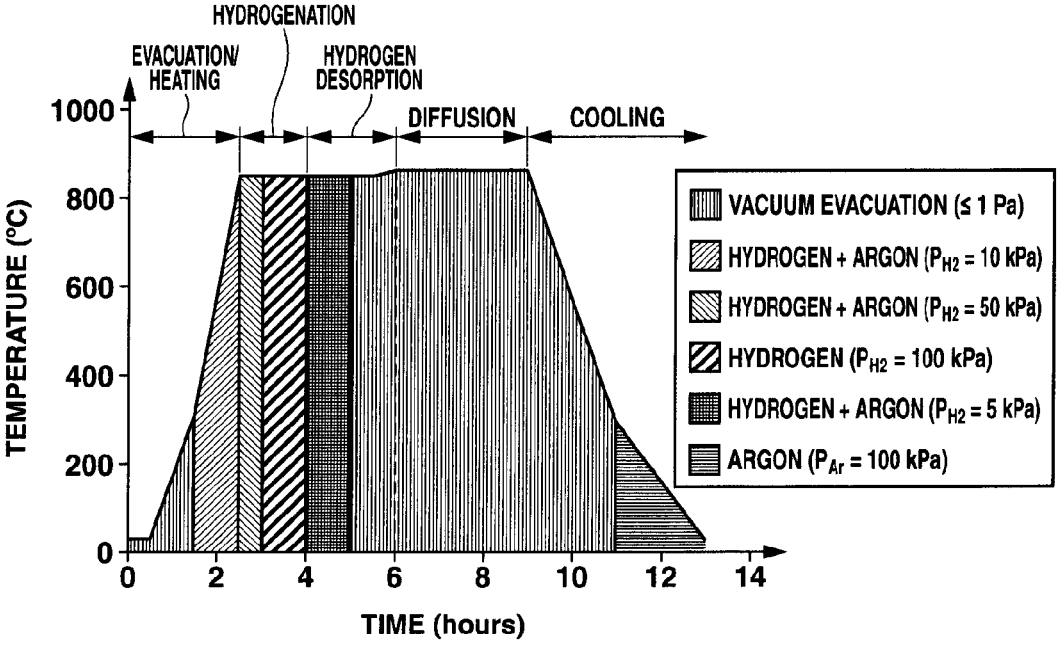
FIG. 6 is a diagram showing the heat treatment profile of HDDR and diffusion treatments in Example 2 and Comparative Example 2.

The mother alloy was subjected to HDDR and diffusion treatments in accordance with the profile shown in FIG. 6. Specifically, the mother alloy was placed in a furnace where the atmosphere was evacuated to a vacuum of 1 Pa or below, and heating was started at the same time. When 300° C. was reached, a mixture of hydrogen and argon was fed into the furnace so as to establish a hydrogen partial pressure $P_{H2}$ of 10 kPa. The furnace was further heated to 850° C. Next, as hydrogenation treatment, with the temperature maintained, a mixture of hydrogen and argon was fed into the furnace so as to establish a hydrogen partial pressure $P_{H2}$ of 50 kPa (over 30 minutes), and subsequently only hydrogen was fed into the furnace so as to establish a hydrogen partial pressure $P_{H2}$ of 100 kPa (over 1 hour). Next, as hydrogen desorption, with the temperature maintained at 850° C., a mixture of hydrogen and argon was fed into the furnace so as to establish a hydrogen partial pressure $P_{H2}$ of 5 kPa (over 1 hour), and thereafter, with the gas feed interrupted, evacuation was performed to a vacuum of 1 Pa or below (over 1 hour). Then, as diffusion treatment, heating at 870° C. in vacuum was continued for 200 minutes. Subsequently, the alloy was cooled to 300° C. in vacuum, and finally, with argon gas fed, cooled to room temperature.

The series of heat treatments yielded a microcrystalline alloy in which major phase crystal grains had an average grain size of 0.25 μm and the grain boundary phase had an average width of 6 nm.

Next, the alloy was exposed to a hydrogen atmosphere of 0.11 MPa at room temperature for hydrogen absorption, heated up to 500° C. while vacuum pumping so that hydrogen was partially desorbed, cooled, and sieved, collecting a coarse powder under 50 mesh as microcrystalline alloy powder.

The microcrystalline alloy powder was finely pulverized on a jet mill using high-pressure nitrogen gas, into a fine powder having a weight average particle size of 4.5 μm. The fine powder was magnetized in a pulsed magnetic field of 50 kOe and compacted under a pressure of about 1 ton/cm$^2$ in a nitrogen atmosphere while being oriented in a magnetic field of 15 kOe. The green compact was then placed in a sintering furnace where it was sintered in argon atmosphere at 1,050° C. for 1 hour. It was further heat treated at 550° C. for 1 hour, yielding a sintered magnet block T2.

In Comparative Example 2, the starting material of the above-described composition was high-frequency melted and cast into a flat mold. The cast alloy was subjected to HDDR and diffusion treatments of FIG. 6, pulverization, compaction, sintering and post-sintering heat treatment, yielding a sintered magnet block S2.

Table 2 tabulates the magnetic properties at room temperature and the average grain size of these magnet blocks. Measurements are the same as in Example 1.

TABLE 2

| | Remanence Br (T) | Coercivity Hcj (kA/m) | Maximum energy product $(BH)_{max}$ (kJ/m$^3$) | Average grain size (μm) |
|---|---|---|---|---|
| Example 2: T2 | 1.40 | 1631 | 384 | 0.7 |
| Comparative Example 2: S2 | 1.41 | 1329 | 357 | 2.7 |

The magnet block T2 exhibited a high coercivity and maximum energy product. Despite the same composition and the same treatment history except the casting step, the magnet block S2 exhibited a low coercivity and a low value of maximum energy product reflecting poor squareness. The reason is that the alloy structure obtained from the conventional casting step has a broad grain size distribution and a long distance between precipitated grains of rare earth-rich phase, which prevent grain boundary phase from being uniformly formed so as to surround major phase crystal grains during the diffusion treatment following the HDDR treatment, and as a result, some submicron grains undergo grain growth during the sintering step. It has been demonstrated that the structural morphology resulting from the casting step is critical to produce a sintered magnet within the scope of the invention.

Example 3 and Comparative Example 3

A rare earth sintered magnet was prepared as follows.

A ribbon form mother alloy consisting essentially of 13 at % Nd, 0.5 at % Al, 0.3 at % Cu, 0.1 at % Ga, 0.07 at % Nb, 6.1 at % B, and the balance of Fe was prepared by the strip casting technique, specifically by using Nd, Al, Cu, Nb, and Fe metals having a purity of at least 99 wt %, Ga having a purity of 99.9999 wt %, and ferroboron, high-frequency heating in an Ar atmosphere for melting, and casting the melt onto a single chill roll of copper. In the mother alloy thus obtained, the distance between precipitated grains (grain boundary phase) was 4 μm on average.

The mother alloy was subjected to HDDR and diffusion treatments in accordance with the profile shown in FIG. 5, yielding a microcrystalline alloy in which major phase crystal grains had an average grain size of 0.3 μm and the grain boundary phase had an average width of 6 nm.

Next, the alloy was exposed to a hydrogen atmosphere of 0.11 MPa at room temperature for hydrogen absorption, heated up to 500° C. while vacuum pumping so that hydrogen was partially desorbed, cooled, and sieved, collecting a coarse powder under 50 mesh as microcrystalline alloy powder A3.

Separately, an alloy consisting essentially of 30 at % Nd, 25 at % Fe, and the balance of Co was prepared by weighing Nd, Fe and Co metals having a purity of at least 99 wt %, high-frequency heating in an Ar atmosphere for melting, and casting the melt into a flat mold. The alloy was exposed to 0.11 MPa of hydrogen at room temperature for hydrogen absorption, and sieved, collecting a coarse powder under 50 mesh. The alloy as hydrogen absorbed had a composition consisting of 16.6 at % Nd, 13.8 at % Fe, 24.9 at % Co, and 44.8 at % H (hydrogen). This is designated auxiliary alloy powder B3.

Next, microcrystalline alloy powder A3 and auxiliary alloy powder B3 were weighed in an amount of 90 wt % and 10 wt %, and mixed in a nitrogen-purged V blender for 30 minutes. The powder mixture was finely pulverized on a jet mill using high-pressure nitrogen gas, into a fine powder having a weight average particle size of 4 μm. The fine powder was magnetized in a pulsed magnetic field of 50 kOe and compacted under a pressure of about 1 ton/cm$^2$ in a nitrogen atmosphere while being oriented in a magnetic field of 15 kOe. The green compact was then placed in a sintering furnace where it was sintered in argon atmosphere at 1,060° C. for 1 hour. It was further heat treated at 550° C. for 1 hour, yielding a magnet block T3.

Figure 7:
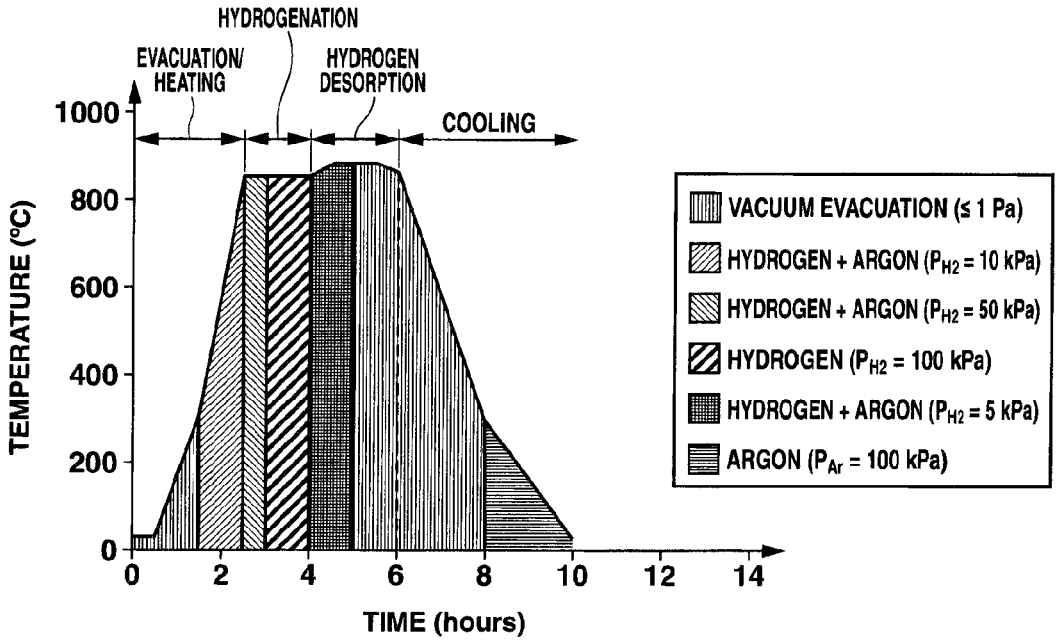
FIG. 7 is a diagram showing the heat treatment profile of HDDR treatment in Comparative Example 3.

In Comparative Example 3, a magnet block S3 was prepared as follows. The strip cast alloy was subjected to only HDDR treatment in accordance with the profile shown in FIG. 7. Specifically, the mother alloy was placed in a furnace where the atmosphere was evacuated to a vacuum of 1

Pa or below, and heating was started at the same time. When 300° C. was reached, a mixture of hydrogen and argon was fed into the furnace so as to establish a hydrogen partial pressure $P_{H2}$ of 10 kPa. The furnace was further heated to 850° C. Next, as hydrogenation treatment, with the temperature maintained, a mixture of hydrogen and argon was fed into the furnace so as to establish a hydrogen partial pressure $P_{H2}$ of 50 kPa (over 30 minutes), and subsequently only hydrogen was fed into the furnace so as to establish a hydrogen partial pressure $P_{H2}$ of 100 kPa (over 1 hour). Next, as hydrogen desorption, with the temperature elevated and held at 870° C., a mixture of hydrogen and argon was fed into the furnace so as to establish a hydrogen partial pressure $P_{H2}$ of 5 kPa (over 1 hour), and thereafter, with the gas feed interrupted, evacuation was performed to a vacuum of 1 Pa or below (over 1 hour). Subsequently, the alloy was cooled to 300° C. in vacuum, and finally, with argon gas fed, cooled to room temperature.

The series of heat treatments yielded a microcrystalline alloy in which major phase crystal grains had an average grain size of 0.3 μm and the grain boundary phase had an average width of 1.8 nm. This alloy was subjected to hydrogen decrepitation as described above, yielding microcrystalline alloy powder P3.

Next, microcrystalline alloy powder P3 and auxiliary alloy powder B3 were weighed in an amount of 90 wt % and 10 wt %, and mixed in a nitrogen-purged V blender for 30 minutes. The subsequent steps were the same as in Example 3. In this way, a sintered magnet block S3 was produced using the alloy not having undergone diffusion treatment following HDDR treatment.

Table 3 tabulates the magnetic properties at room temperature and the average grain size of these magnet blocks. Measurements are the same as in Example 1.

TABLE 3

| | Remanence Br (T) | Coercivity Hcj (kA/m) | Maximum energy product $(BH)_{max}$ (kJ/m$^3$) | Average grain size (μm) |
|---|---|---|---|---|
| Example 3: T3 | 1.41 | 1401 | 386 | 1.3 |
| Comparative Example 3: S3 | 1.41 | 1345 | 341 | 12.8 |

As compared with inventive magnet block T3, magnet block S3 not having undergone diffusion treatment following HDDR treatment has an about 50 kA/m lower value of coercivity and a 45 kJ/m$^3$ lower value of maximum energy product. In magnet block S3, since some major phase crystal grains experienced an abnormal grain growth as large as several tens of microns, the major phase crystal grains had an average grain size of 12.8 μm, which was larger than in ordinary sintered magnets. With only HDDR treatment as in Comparative Example 3, grain boundary phase is not formed to a sufficient width, and major phase crystal grains are prone to grain growth during the sintering step. It has been demonstrated that the structural morphology that submicron major phase crystal grains are uniformly surrounded by grain boundary phase of sufficient width prior to the sintering step is critical to produce a sintered magnet within the scope of the invention.

While the invention has been described with reference to preferred embodiments, it will be understood by those skilled in the art that various changes may be made and equivalents may be substituted for elements thereof without departing from the scope of the invention. Therefore, it is intended that the invention not be limited to the particular embodiments disclosed as the best mode contemplated for carrying out this invention, but that the invention will include all embodiments falling within the scope of the appended claims.

Japanese Patent Application No. 2012-229999 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a R—Fe—B rare earth sintered magnet comprising $Nd_2Fe_{14}B$ crystal phase as major phase, wherein R is an element or a combination of two or more elements selected from rare earth elements inclusive of Sc and Y and contains Nd and/or Pr, said method consisting of: step (A) of preparing a microcrystalline alloy powder, said step (A) consisting of sub-step (a) of strip casting an alloy having the composition $R^1{}_aT_bM_cA_d$ wherein $R^1$ is an element or a combination of two or more elements selected from rare earth elements inclusive of Sc and Y and contains Nd and/or Pr, T is Fe or Fe and Co, M is a combination of two or more elements selected from the group consisting of Al, Cu, Zn, In, P, S, Ti, Si, V, Cr, Mn, Ni, Ga, Ge, Zr, Nb, Mo, Pd, Ag, Cd, Sn, Sb, Hf, Ta, and W and contains Al and Cu, A is B (boron) or B and C (carbon), "a" to "d" indicative of atomic percent in the alloy are in the range: 12.5≤a≤18, 0.2≤c≤10, 5≤d≤10, and the balance of b, and consisting essentially of crystal grains of $Nd_2Fe_{14}B$ crystal phase and precipitated grains of $R^1$-rich phase, the grains of $R^1$-rich phase being precipitated in such a distribution that the average distance between precipitated grains is up to 20 μm, thereby obtaining a strip cast alloy, sub-step (b) of hydrogenation-disproportionation-desorption-recombination (HDDR) treatment of heating the strip cast alloy in hydrogen atmosphere at 700 to 1,000° C. to induce disproportionation reaction to disproportionate the $Nd_2Fe_{14}B$ crystal phase into $R^1$ hydride, Fe, and $Fe_2B$, then heating the alloy under a reduced hydrogen partial pressure at 700 to 1,000° C. to recombine them into $Nd_2Fe_{14}B$ crystal phase, for thereby forming submicron crystal grains having an average grain size of 0.1 to 1 μm, thereby obtaining an HDDR-treated alloy, sub-step (c) of diffusion treatment of heating the HDDR-treated alloy in vacuum or in an inert gas atmosphere at a temperature of 600 to 1,000° C. for a time of 1 to 50 hours, for thereby preparing a microcrystalline alloy intermediate product consisting essentially of submicron crystal grains of $Nd_2Fe_{14}B$ crystal phase having an average grain size of 0.1 to 1 μm and $R^1$-rich grain boundary phase surrounding the submicron crystal grains across an average width of 2 to 10 nm, and sub-step (d) of pulverizing the microcrystalline alloy intermediate product into a microcrystalline alloy powder, step (B) of pulverizing the microcrystalline alloy powder into a fine powder, and magnetizing the fine powder, step (C) of compacting the magnetized fine powder in a magnetic field into a green compact, and step (D) of heating the green compact in vacuum or in an inert gas atmosphere at 900 to 1,100° C. for sintering, thereby yielding a R—Fe—B rare earth sintered magnet having an average grain size of 0.2 to 2 μm.

2. The method of claim 1 wherein $R^1$ in the composition of the microcrystalline alloy powder contains at least 80 at % of Nd and/or Pr based on all $R^1$.

3. The method of claim 1 wherein T in the composition of the microcrystalline alloy powder contains at least 85 at % of Fe based on all T.

4. A rare earth sintered magnet which is prepared by the method of claim 1, comprising $Nd_2Fe_{14}B$ crystal phase as major phase, wherein R is an element or a combination of two or more elements selected from rare earth elements inclusive of Sc and Y and contains Nd and/or Pr, and having a coercivity of 1400 kA/m or more.

5. The method of claim 1, wherein the $R^1$-rich grain boundary phase in the microcrystalline alloy powder has an average width of 4 to 10 nm.

6. A method for preparing a R—Fe—B rare earth sintered magnet comprising $Nd_2Fe_{14}B$ crystal phase as major phase, wherein R is an element or a combination of two or more elements selected from rare earth elements inclusive of Sc and Y and contains Nd and/or Pr, said method consisting of:

step (A) of preparing a microcrystalline alloy powder, said step (A) consisting of sub-step (a) of strip casting an alloy having the composition $R^1{}_aT_bM_cA_d$ wherein $R^1$ is an element or a combination of two or more elements selected from rare earth elements inclusive of Sc and Y and contains Nd and/or Pr, T is Fe or Fe and Co, M is a combination of two or more elements selected from the group consisting of Al, Cu, Zn, In, P, S, Ti, Si, V, Cr, Mn, Ni, Ga, Ge, Zr, Nb, Mo, Pd, Ag, Cd, Sn, Sb, Hf, Ta, and W and contains Al and Cu, A is B (boron) or B and C (carbon), "a" to "d" indicative of atomic percent in the alloy are in the range: $12.5 \leq a \leq 18$, $0.2 \leq c \leq 10$, $5 \leq d \leq 10$, and the balance of b, and consisting essentially of crystal grains of $Nd_2Fe_{14}B$ crystal phase and precipitated grains of $R^1$-rich phase, the grains of $R^1$-rich phase being precipitated in such a distribution that the average distance between precipitated grains is up to 20 μm, thereby obtaining a strip cast alloy, sub-step (b) of hydrogenation-disproportionation-desorption-recombination (HDDR) treatment of heating the strip cast alloy in hydrogen atmosphere at 700 to 1,000° C. to induce disproportionation reaction to disproportionate the $Nd_2Fe_{14}B$ crystal phase into $R^1$ hydride, Fe, and $Fe_2B$, then heating the alloy under a reduced hydrogen partial pressure at 700 to 1,000° C. to recombine them into $Nd_2Fe_{14}B$ crystal phase, for thereby forming submicron crystal grains having an average grain size of 0.1 to 1 μm, thereby obtaining an HDDR-treated alloy, and sub-step (c) of diffusion treatment of heating the HDDR-treated alloy in vacuum or in an inert gas atmosphere at a temperature of 600 to 1,000° C. for a time of 1 to 50 hours, for thereby preparing a microcrystalline alloy powder intermediate product consisting essentially of submicron crystal grains of $Nd_2Fe_{14}B$ crystal phase having an average grain size of 0.1 to 1 μm and $R^1$-rich grain boundary phase surrounding the submicron crystal grains across an average width of 2 to 10 nm, and sub-step (d) of pulverizing the microcrystalline alloy intermediate product into a microcrystalline alloy powder, step (B) of pulverizing the microcrystalline alloy powder into a fine powder, and magnetizing the fine powder, step (C) of compacting the magnetized fine powder in a magnetic field into a green compact, step (D) of heating the green compact in vacuum or in an inert gas atmosphere at 900 to 1,100° C. for sintering, thereby yielding a R—Fe—B rare earth sintered magnet having an average grain size of 0.2 to 2 μm, and step (E) of heat treating at a temperature lower than the sintering temperature in step (D).

7. A rare earth sintered magnet which is prepared by the method of claim 6, comprising $Nd_2Fe_{14}B$ crystal phase as major phase, wherein R is an element or a combination of two or more elements selected from rare earth elements inclusive of Sc and Y and contains Nd and/or Pr, and having a coercivity of 1400 kA/m or more.

8. A method for preparing a R—Fe—B rare earth sintered magnet comprising $Nd_2Fe_{14}B$ crystal phase as major phase, wherein R is an element or a combination of two or more elements selected from rare earth elements inclusive of Sc and Y and contains Nd and/or Pr, said method consisting of:

step (A) of preparing a microcrystalline alloy powder, said step (A) consisting of sub-step (a) of strip casting an alloy having the composition $R^1{}_aT_bM_cA_d$ wherein $R^1$ is an element or a combination of two or more elements selected from rare earth elements inclusive of Sc and Y and contains Nd and/or Pr, T is Fe or Fe and Co, M is a combination of two or more elements selected from the group consisting of Al, Cu, Zn, In, P, S, Ti, Si, V, Cr, Mn, Ni, Ga, Ge, Zr, Nb, Mo, Pd, Ag, Cd, Sn, Sb, Hf, Ta, and W and contains Al and Cu, A is B (boron) or B and C (carbon), "a" to "d" indicative of atomic percent in the alloy are in the range: $12.5 \leq a \leq 18$, $0.2 \leq c \leq 10$, $5 \leq d \leq 10$, and the balance of b, and consisting essentially of crystal grains of $Nd_2Fe_{14}B$ crystal phase and precipitated grains of $R^1$-rich phase, the grains of $R^1$-rich phase being precipitated in such a distribution that the average distance between precipitated grains is up to 20 μm, thereby obtaining a strip cast alloy, sub-step (b) of hydrogenation-disproportionation-desorption-recombination (HDDR) treatment of heating the strip cast alloy in hydrogen atmosphere at 700 to 1,000° C. to induce disproportionation reaction to disproportionate the $Nd_2Fe_{14}B$ crystal phase into $R^1$ hydride, Fe, and $Fe_2B$, then heating the alloy under a reduced hydrogen partial pressure at 700 to 1,000° C. to recombine them into $Nd_2Fe_{14}B$ crystal phase, for thereby forming submicron crystal grains having an average grain size of 0.1 to 1 μm, thereby obtaining an HDDR-treated alloy, sub-step (c) of diffusion treatment of heating the HDDR-treated alloy in vacuum or in an inert gas atmosphere at a temperature of 600 to 1,000° C. for a time of 1 to 50 hours, for thereby preparing a microcrystalline powder intermediate product consisting essentially of submicron crystal grains of $Nd_2Fe_{14}B$ crystal phase having an average grain size of 0.1 to 1 μm and $R^1$-rich grain boundary phase surrounding the submicron crystal grains across an average width of 2 to 10 nm, and sub-step (d) of pulverizing the microcrystalline alloy intermediate product into a microcrystalline alloy powder, step (A') of mixing more than 0% to 15% by weight of an auxiliary alloy powder with the microcrystalline alloy powder of step (A), said auxiliary alloy having the composition $R^2{}_eK_f$ wherein $R^2$ is an element or a combination of two or more elements selected from rare earth elements inclusive of Sc and Y and contains at least one element selected from among Nd, Pr, Dy, Tb and Ho, K is an element or a combination of two or more elements selected from the group consisting of Fe, Co, Zn, In, P, S, Ti, Si, V, Cr, Mn, Ni, Ga, Ge, Zr, Nb, Mo, Pd, Ag, Cd, Sn, Sb, Hf, Ta, W, H, and F, e and f indicative of atomic percent in the alloy are in the range: $20 \leq e \leq 95$ and the balance of f;

step (B) of pulverizing the microcrystalline alloy powder into a fine powder, and magnetizing the fine powder;

step (C) of compacting the magnetized fine powder in a magnetic field into a green compact; and step (D) of heating the green compact in vacuum or in an inert gas atmosphere at 900 to 1,100° C. for sintering, thereby yielding a R—Fe—B rare earth sintered magnet having an average grain size of 0.2 to 2 μm.

9. The method of claim 8, wherein $R^1$ in the composition of the microcrystalline alloy powder contains at least 80 at % of Nd and/or Pr based on all $R^1$.

10. The method of claim 8, wherein T in the composition of the microcrystalline alloy powder contains at least 85 at % of Fe based on all T.

11. A rare earth sintered magnet which is prepared by the method of claim 8, comprising $Nd_2Fe_{14}B$ crystal phase as major phase, wherein R is an element or a combination of two or more elements selected from rare earth elements inclusive of Sc and Y and contains Nd and/or Pr, and having a coercivity of 1400 kA/m or more.

12. The method of claim 8, wherein the $R^1$-rich grain boundary phase in the microcrystalline alloy powder has an average width of 4 to 10 nm.

13. A method for preparing a R—Fe—B rare earth sintered magnet comprising $Nd_2Fe_{14}B$ crystal phase as major phase, wherein R is an element or a combination of two or more elements selected from rare earth elements inclusive of Sc and Y and contains Nd and/or Pr, said method consisting of:

step (A) of preparing a microcrystalline alloy powder, said step (A) consisting of sub-step (a) of strip casting an alloy having the composition $R^1{}_aT_bM_cA_d$ wherein $R^1$ is an element or a combination of two or more elements selected from rare earth elements inclusive of Sc and Y and contains Nd and/or Pr, T is Fe or Fe and Co, M is a combination of two or more elements selected from the group consisting of Al, Cu, Zn, In, P, S, Ti, Si, V, Cr, Mn, Ni, Ga, Ge, Zr, Nb, Mo, Pd, Ag, Cd, Sn, Sb, Hf, Ta, and W and contains Al and Cu, A is B (boron) or B and C (carbon), "a" to "d" indicative of atomic percent in the alloy are in the range: $12.5 \leq a \leq 18$, $0.2 \leq c \leq 10$, $5 \leq d \leq 10$, and the balance of b, and consisting essentially of crystal grains of $Nd_2Fe_{14}B$ crystal phase and precipitated grains of $R^1$-rich phase, the grains of $R^1$-rich phase being precipitated in such a distribution that the average distance between precipitated grains is up to 20 μm, thereby obtaining a strip cast alloy, sub-step (b) of hydrogenation-disproportionation-desorption-recombination (HDDR) treatment of heating the strip cast alloy in hydrogen atmosphere at 700 to 1,000° C. to induce disproportionation reaction to disproportionate the $Nd_2Fe_{14}B$ crystal phase into $R^1$ hydride, Fe, and $Fe_2B$, then heating the alloy under a reduced hydrogen partial pressure at 700 to 1,000° C. to recombine them into $Nd_2Fe_{14}B$ crystal phase, for thereby forming submicron crystal grains having an average grain size of 0.1 to 1 μm, thereby obtaining an HDDR-treated alloy, sub-step (c) of diffusion treatment of heating the HDDR-treated alloy in vacuum or in an inert gas atmosphere at a temperature of 600 to 1,000° C. for a time of 1 to 50 hours, for thereby preparing a microcrystalline alloy powder intermediate product consisting essentially of submicron crystal grains of $Nd_2Fe_{14}B$ crystal phase having an average grain size of 0.1 to 1 μm and $R^1$-rich grain boundary phase surrounding the submicron crystal grains across an average width of 2 to 10 nm, and sub-step (d) of pulverizing the microcrystalline alloy intermediate product into a microcrystalline alloy powder;

step (A') of mixing more than 0% to 15% by weight of an auxiliary alloy powder with the microcrystalline alloy powder of step (A), said auxiliary alloy having the composition $R^2{}_eK_f$ wherein $R^2$ is an element or a combination of two or more elements selected from rare earth elements inclusive of Sc and Y and contains at least one element selected from among Nd, Pr, Dy, Tb and Ho, K is an element or a combination of two or more elements selected from the group consisting of Fe, Co, Zn, In, P, S, Ti, Si, V, Cr, Mn, Ni, Ga, Ge, Zr, Nb, Mo, Pd, Ag, Cd, Sn, Sb, Hf, Ta, W, H, and F, e and f indicative of atomic percent in the alloy are in the range: $20 \leq e \leq 95$ and the balance of f;

step (B) of pulverizing the microcrystalline alloy powder into a fine powder, and magnetizing the fine powder;

step (C) of compacting the magnetized fine powder in a magnetic field into a green compact; and step (D) of heating the green compact in vacuum or in an inert gas atmosphere at 900 to 1,100° C. for sintering, thereby yielding a R—Fe—B rare earth sintered magnet having an average grain size of 0.2 to 2 μm; and step (E) of heat treating at a temperature lower than the sintering temperature in step (D).

14. A rare earth sintered magnet which is prepared by the method of claim 13, comprising $Nd_2Fe_{14}B$ crystal phase as major phase, wherein R is an element or a combination of two or more elements selected from rare earth elements inclusive of Sc and Y and contains Nd and/or Pr, and having a coercivity of 1400 kA/m or more.

15. A method for preparing a microcrystalline alloy intermediate product for manufacturing a R—Fe—B rare earth sintered magnet comprising $Nd_2Fe_{14}B$ crystal phase as major phase, wherein R is an element or a combination of two or more elements selected from rare earth elements inclusive of Sc and Y and contains Nd and/or Pr, said method consisting of:

step (a) of strip casting an alloy having the composition $R^1{}_aT_bM_cA_d$ wherein $R^1$ is an element or a combination of two or more elements selected from rare earth elements inclusive of Sc and Y and contains Nd and/or Pr, T is Fe or Fe and Co, M is a combination of two or more elements selected from the group consisting of Al, Cu, Zn, In, P, S, Ti, Si, V, Cr, Mn, Ni, Ga, Ge, Zr, Nb, Mo, Pd, Ag, Cd, Sn, Sb, Hf, Ta, and W and contains Al and Cu, A is B (boron) or B and C (carbon), "a" to "d" indicative of atomic percent in the alloy are in the range: $12.5 \leq a \leq 18$, $0.2 \leq c \leq 10$, $5 \leq d \leq 10$, and the balance of b, and consisting essentially of crystal grains of $Nd_2Fe_{14}B$ crystal phase and precipitated grains of $R^1$-rich phase, the grains of $R^1$-rich phase being precipitated in such a distribution that the average distance between precipitated grains is up to 20 μm, thereby obtaining a strip cast alloy, step (b) of hydrogenation-disproportionation-desorption-recombination (HDDR) treatment of heating the strip cast alloy in hydrogen atmosphere at 700 to 1,000° C. to induce disproportionation reaction to disproportionate the $Nd_2Fe_{14}B$ crystal phase into $R^1$ hydride, Fe, and $Fe_2B$, then heating the alloy under a reduced hydrogen partial pressure at 700 to 1,000° C. to recombine them into $Nd_2Fe_{14}B$ crystal phase, for thereby forming submicron crystal grains having an average grain size of 0.1 to 1 μm, thereby obtaining an HDDR-treated alloy, and step (c) of diffusion treatment of heating the HDDR-treated alloy in vacuum or in an inert gas atmosphere at a temperature of 600 to 1,000° C. for a time of 1 to 50 hours, thereby preparing a microcrystalline alloy intermediate product consisting essentially of submicron crystal grains of $Nd_2Fe_{14}B$ crystal phase having an average grain size of 0.1 to 1 μm and $R^1$-rich grain boundary phase surrounding the submicron crystal grains across an average width of 2 to 10 nm.

16. The method of claim 15 wherein $R^1$ in the composition of the microcrystalline alloy intermediate product contains at least 80 at % of Nd and/or Pr based on all R'.

17. The method of claim 15 wherein T in the composition of the microcrystalline alloy intermediate product contains at least 85 at % of Fe based on all T.

18. A microcrystalline alloy intermediate product which is prepared by the method of claim 15, consisting essentially of submicron crystal grains of $Nd_2Fe_{14}B$ crystal phase having an average grain size of 0.1 to 1 μm and $R^1$-rich grain boundary phase surrounding the submicron crystal grains across an average width of 2 to 10 nm.

* * * * *